United States Patent [19]

Knapp et al.

[11] Patent Number: 4,555,060

[45] **Date of Patent: * Nov. 26, 1985**

[54] ELECTROMAGNETICALLY ACTUATED VALVE, IN PARTICULAR A FUEL INJECTION VALVE FOR FUEL INJECTION SYSTEMS

[75] Inventors: Heinrich Knapp, Leonberg; Rudolf Sauer, Benningen; Rudolf Krauss, Stuttgart; Udo Hafner, Lorch, all of Fed. Rep. of Germany

[73] Assignee: Robert Bosch GmbH, Stuttgart, Fed. Rep. of Germany

[ * ] Notice: The portion of the term of this patent subsequent to Nov. 22, 2000 has been disclaimed.

[21] Appl. No.: 633,677

[22] Filed: Jul. 25, 1984

Related U.S. Application Data

[63] Continuation of Ser. No. 376,463, May 10, 1982, abandoned.

[30] Foreign Application Priority Data

May 13, 1981 [DE] Fed. Rep. of Germany ..... 3118898

[51] Int. Cl.[4] ..... F02M 51/00

[52] U.S. Cl. ..... 239/585

[58] Field of Search ..... 239/585; 251/139–141

[56] References Cited

U.S. PATENT DOCUMENTS 3,241,768 3/1966 Croft ..... 239/585

3,567,135 3/1971 Gebert ..... 239/585

4,365,747 12/1982 Knapp et al. ..... 239/585 X 4,416,423 11/1983 Krauss et al. ..... 239/585

FOREIGN PATENT DOCUMENTS 2303450 8/1974 Fed. Rep. of Germany ..... 251/141

*Primary Examiner*—Andres Kashnikow
*Assistant Examiner*—James R. Moon, Jr.
*Attorney, Agent, or Firm*—Edwin E. Greigg

[57] ABSTRACT

An electromagnetically actuatable valve which serves in particular to inject fuel into the intake tube of internal combustion engines operating with fuel injection systems. The fuel injection valve includes a valve housing, a shell core having a magnetic winding and a flat armature, which is firmly connected with a valve element which passes through a central guide opening in a guide diaphragm and cooperates with a fixed valve seat. The guide diaphragm has a fastening zone and together with the central guide opening cut out of a centering zone of the guide diaphragm guides the valve element in the radial direction toward the valve seat. The fastening zone is connected via struts with an annular guide zone on which the flat armature, under spring tension, rests with a concentric guide edge and is guided in a plane parallel to the end face of the shell core. The centering zone of the guide diaphragm is connected in turn via struts with the guide zone.

4 Claims, 2 Drawing Figures

ELECTROMAGNETICALLY ACTUATED VALVE, IN PARTICULAR A FUEL INJECTION VALVE FOR FUEL INJECTION SYSTEMS

This is a continuation of copending application Ser. No. 376,463, filed May 10, 1982, now abandoned.

BACKGROUND OF THE INVENTION

The invention is based on an electromagnetically actuatable valve as generally described herein. An electromagnetically actuatable valve is already known in which the armature is firmly connected to a guide diaphragm fastened to the housing at its outer circumference. However, this arrangement has the disadvantage that an additional operation is required to connect the armature and the guide diaphragm, and as a result of this connection, stresses in the guide diaphragm occur which cause the armature to tilt relative to the core; the danger then exists, first, that the armature will not be attracted in a parallel direction and, second, that the valve element may come to rest on the valve seat only on one side when the valve closes.

OBJECT AND SUMMARY OF THE INVENTION

The valve according to the invention has the advantage over the prior art of low-friction and plane-parallel guidance of the flat armature, while eliminating one additional operation and thereby preventing an oblique guidance of the armature caused by stresses in the guide diaphragm.

Advantageous further embodiments of and improvements to the valve disclosed in the main claim can be attained with the characteristics disclosed in the dependent claims. The simultaneous centering of the valve element effected by means of the guide diaphragm is particularly advantageous. It is also advantageous to round off the concentric guide edge of the flat armature which cooperates with the guide diaphragm, in order to enable wear-free roll-off of the surfaces on one another. It is of further advantage to round off the edge of the outer circumference of the flat armature oriented toward the core, thus attaining a reduction in wear.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
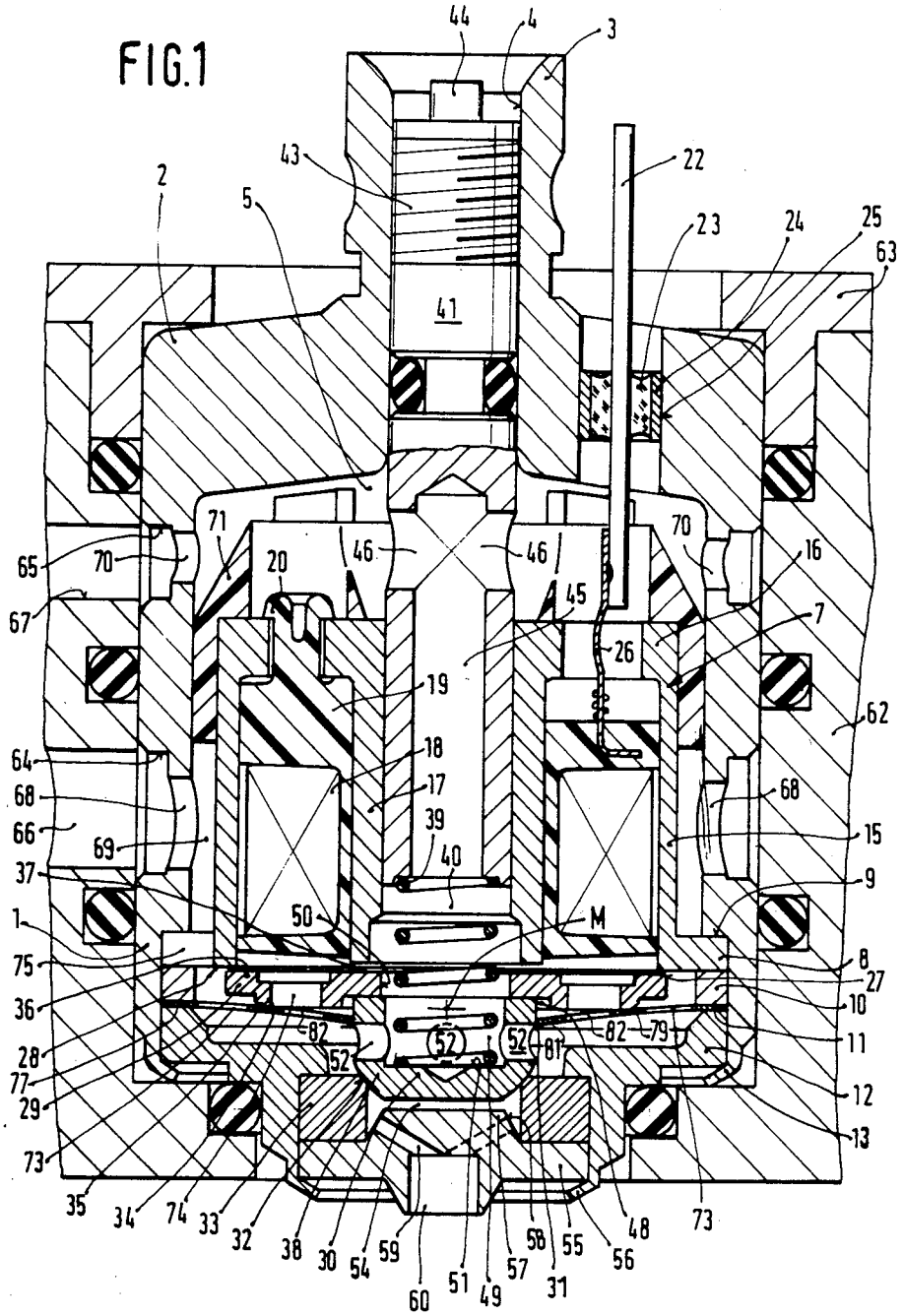
FIG. 1 shows in cross-section an electromagnetically actuatable fuel injection valve.

The fuel injection valve shown in FIG. 1 and intended for a fuel injection system serves by way of example for the injection of fuel, especially at low pressure, into the intake tube of mixture-compressing internal combustion engines with externally-supplied ignition. A valve housing 1 is fabricated by some method not producing chips, for instance, deep drawing, rolling or the like. It has a cup-like shape with a base 2, beginning at which there is a tubular guide fitting 3, which has a guide bore 4 likewise passing through the base 2 and discharging in the interior 5 of the valve housing 1.

A shell-type core 7 of ferromagnetic material is inserted into the interior 5 of the valve housing 1; the core 7 has a diameter smaller than that of the interior 5 and rests with a shoulder 8 on an inner step 9 of the valve housing 1. The side of the shoulder 8 remote from the inner step 9 is engaged by a spacer ring 10, which is followed by a guide diaphragm 11 and a nozzle carrier 12. A crimped edge 13 partially surrounds the end face of the nozzle carrier 12, engaging it and exerting axial tension thereon so as to assure the positional fixation of the shell core 7, the spacer ring 10, the guide diaphragm 11 and the nozzle carrier 12. A conventional shell core available on the market from Siemens and known as T 26 can be used for the shell core 7; this element has an annular outer core 15 and an annular inner core 17 connected therewith via a crosspiece 16. A magnetic winding 18 may be at least partially enclosed by an insulating carrier body 19, which together with the magnetic winding 18 is inserted into the annular space of the shell core 7 formed between the outer core 15 and the inner core 17 and is connected in a positively engaged manner, for instance by rivets 20 or a releasable snap connection, with the crosspiece 16. The supply of current to the magnetic winding 18 is efficaciously accomplished via contact prongs 22, only one of which is shown and which are embedded in an insulation insert 23 of glass, for example. The insulation insert 23 may be surrounded by a fastening ring 24 sealingly inserted in a passageway bore 25 of the valve housing bottom 2 and soldered, for instance. Plug connections or an electric cable may be connected with the contact prongs 22 in a manner not shown but known per se. In order to compensate for changes in length caused by heat expansion, one contact lug 26 is provided between the magnetic winding 18 and each of the contact prongs 22.

A flat armature 29 is disposed between the end face of the shell core 7 remote from the crosspiece 16 and the guide diaphragm 11. A movable valve element 30 is connected, for instance by soldering or welding, with the middle area of the flat armature 29. The valve element 30 passes through a central guide opening 31 in the guide diaphragm 11 and cooperates with a fixed valve seat 32 formed in a valve seat body 33. The valve seat body 33 is inserted into the nozzle carrier 12. The valve element 30 and the flat armature 29 are guided in the radial direction, relative to the valve seat 32 on one side and to the end face 28 of the shell core 7 on the other, by the central guide opening 31 of the guide diaphragm 11. The guide diaphragm 11 is rigidly connected neither with the valve element 30 nor with the flat armature 29. The flat armature 29 may be embodied as a stamped or press-cast element and may by way of example have an annular guide ring 34 oriented toward the guide diaphragm 11. First, the guide ring 34 improves the rigidity of the flat armature 29; second, it separates a first work zone 36 of the flat armature, which is oriented toward the end face of the outer core 15, from a second work zone 37, which is oriented toward the end face of the inner core 17; and third, it forms a concentric guide edge 35 which rests on the guide diaphragm 11, as a result of which the flat armature 29 is guided in a plane parallel to the end face 28 of the shell core 7. The guide edge 35 is embodied as rounded off, so that it can roll off on the guide diaphragm in a wear-free manner.

In order to reduce wear, the outer circumferential edge 27 oriented toward the outer core 15 is also rounded off. The valve element 30 has a spherical section 38 cooperating with the valve seat 32, which is embodied by way of example as a flattened spherical zone. The fastening of the guide diaphragm 11 between the spacer ring 10 and the nozzle carrier 12 is effected in a plane which when the valve element 30 is resting on the valve seat 32 passes through the center point M, or as close as possible to the center point M, of the spherical section 38. When the valve element 30 is resting on the valve seat 32, the guide diaphragm 11, drawn into a curve by the tension exerted on it, rests on the guide edge 35 of the flat armature 29. The valve element 30 is urged in the closing direction of the valve by a compression spring 39, which on the other end protrudes into an inner bore 40 of the shell core 7 and is supported on a slide member 41. The force of the compression spring 39 exerted on the flat armature 29 and the valve element 30 can be influenced by axially displacing the slide member 41.

On its end remote from the flat armature, the slide member 41 is pressed into the guide bore 4 by the base 2 and the guide fitting 3, and in the vicinity of the guide fitting 3 it has a section with notches 43, for instance flat annular bores, threads, beads or the like, in order to assure improved axial fixation of the slide member 41; the guide fitting 3 is pressed inward in the vicinity of the notches 43, so that material from the guide fitting 3 is forced into the notches 43 of the slide member 41. The end of the slide member 41 remote from the flat armature 29 is embodied such that it terminates inside the guide fitting 3 and has a tang 44 whose diameter is smaller than that of the guide bore 4. A suitable tool may engage the tang 44 in order to displace the slide member 41. The slide member 41 has a longitudinal bore 44 open toward the flat armature 29, which discharges at its other end, outside the shell core 7, into transverse bores 46 relative to the circumference of the slide member 41 in the interior of the valve housing 1.

The valve element 30 has a cylindrical section 48 connected with the flat armature 29 and adjacent to which is the spherical section 38 of the valve element. The valve element 30 is provided with a concentric blind bore 49 which is open toward the flat armature 29 and leads as far as possible into the spherical section 38. The compresson spring 39 resting at one end on the slide member 41 passes through an opening 50 in the flat armature and is supported on the other end in the valve element 30, on the bottom 51 of the blind bore 49, as a result of which when the magnetic circuit 7, 18, 29 is not excited the valve element 30 is held in a sealing manner on the valve seat 32, counter to the spring force of the guide diaphragm 11. Transverse bores or apertures 52 extend from the circumference of the valve element 30 toward the blind bore 49.

A collector chamber 54 is formed downstream of the valve seat 32, and its volume should be as small as possible; the chamber 54 is defined by the valve seat body 33, the spherical section 38 and a spin body 55 disposed downstream of the valve seat body 33. A crimped area 56 of the nozzle carrier 12 grips around a face of the spin body 55 remote from the valve seat body 33; as a result, the valve seat body 33 and the spin body 55 are fixed in their positions. The spin body 55 has a protrusion 57 projecting into the collector chamber 54; its end face oriented toward the valve element 30 is flattened, and spin conduits 59 which are open toward the collector chamber 54 branch off from its lateral circumferential wall 58, which has a conical course, by way of example. The spin conduits 59 may be inclined at an angle relative to the valve axis and they discharge into a spin chamber 60. The spin conduits 59 may discharge into the spin chamber 60 at a tangent, for example, and they serve the purpose of metering fuel. The fuel film which forms on the wall of the spin chamber 60 rips off at the sharply-pointed end of the spin chamber 60, which discharges into the intake tube, and thus enters the air flow of the intake tube in a conical pattern; as a result, particularly at low fuel pressures, good fuel preparation is assured.

The fuel injection valve supported in a holder body 62 may be fixed in its position by a claw, for instance, or by a cap 63. In the valve housing 1, the fuel injection valve has a first annular groove 64 and, offset in the axial direction and sealed off from the first annular groove 64, a second annular groove 65. A fuel inlet line 66 is embodied in the holder body 62 and discharges into the first annular groove 64. A fuel return-flow ine 67 is also embodied in the holder body 62, communicating with the second annular groove 65. Radial inlet openings 68 in the wall of the cylindrical, tubular part of the valve housing 1 connect the first annular groove 64 with a flow conduit 69 embodied between the outer core 15 and the inner wall of the valve housing 1. The part of the interior 5 located above the shell core 7 communicates with the second annular groove 65 via radially extending outflow openings 70 embodied in the cylindrical, tubular part of the valve housing and is separated from the flow conduit 69 by a sealing body 71. The guide diaphragm 11 has flowthrough openings 73, which may also be embodied as flowthrough openings 74 in the flat armature 29. The fuel flowing into the flow conduit 69 via the inlet openings 68 can flow to the valve seat 32 via openings 75 in the shoulder 8 and the flowthrough openings 73 in the guide diaphragm 11; from the valve seat 32, the fuel flows into the collector chamber 54 when the valve element 30 is raised from the valve seat 32 and is there metered by way of the spin conduits 59. The non-metered portion of the fuel can flow into the blind bore 49 of the valve element 30 by way of the transverse bores 52; from the blind bore 49, it can flow by way of the inner bore 40 or the longitudinal bore 45 of the slide member 41 and the transverse bores 46 into the portion of the interior 5 located above the shell core 7, as it flows absorbing the heat created in the magnetic circuit, and from there the fuel flows back into the fuel return-flow line 67 via the discharge openings 70 and the second annular groove 65.

Figure 2:
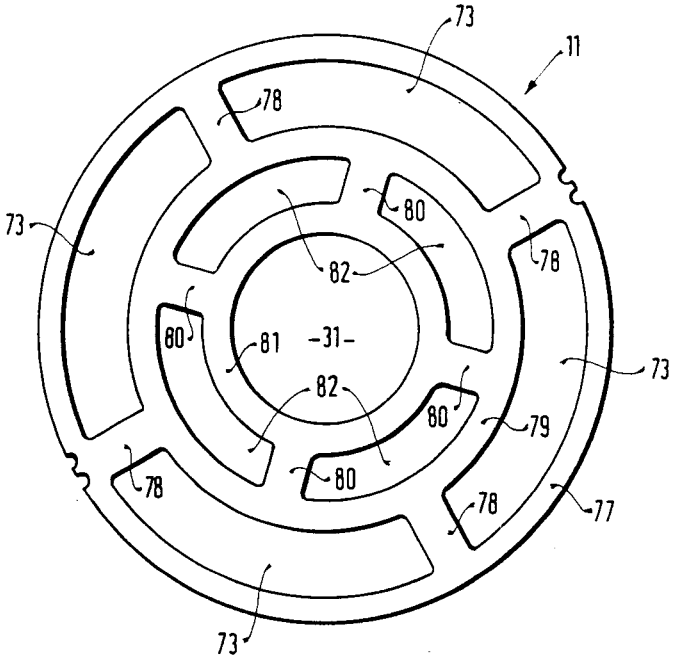
FIG. 2 shows a top plan view of guide diaphragm in accordance with the invention.

In FIG. 2, the guide diaphragm 11 is shown in plan view. The guide diaphragm 11 is formed of spring-metal and has an annular fastening zone 77 in accordance with the invention, which is fastened between the spacer ring 10 and the nozzle carrier 12 of the valve. The fastening zone 77 is connected with an annular guide zone 79 of lesser diameter via radially extending struts 78; in the guide diaphargm 11 illustrated, four struts 78 offset from one another by 90° are provided. The guide edge 35 of the flat armature 29 is supported on this annular guide zone 79. An annular centering zone 81 having a smaller diameter than that of the guide zone 79 is connected with the guide zone 79 via further struts 80; the centering zone 81 surrounds the central guide opening 31 in order to center the valve element 30. Arcuate flowthrough openings 82 have been left open between the guide zone 79, the struts 80 and the centering zone 81. In the illustrated guide diaphragm 11, four struts 80 are provided, which are offset from one another by 90° and are offset from the respective struts 78 by 45°.

The force exerted by the guide diaphragm on the flat armature 29 can be influenced by appropriately embodying the width of the struts 78.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electromagnetically actuatable valve for fuel injection valves for fuel injection systems of internal combustion engines, having a valve housing, a magnetic winding applied on a core or ferromagnetic material, and an armature which is firmly connected with a valve element said valve element arranged to cooperate with a fixed valve seat, said valve element adapted to freely pass through a guide diaphragm formed of spring-metal and guided by said guide diaphragm, said guide diaphragm having a circumference which is fastened to said housing, said guide diaphragam has an annular fastening zone and an annular inner guide zone of smaller diameter, each of said zones being interconnected by means of radially extending struts which are offset relative to each other arcuately and radially in each of said zones and thereby provided arcuate flowthrough openings, said inner guide zone of said guide diaphragm arranged to rest under spring tension on a concentric guide ring of said armature, said armature further having a surface oriented toward the valve seat whereby said guide diaphragm retains said armature parallel to said valve seat and to an end face of said core of ferromagnetic material, said guide diaphragm further including a centrally disposed annular zone supported by radial struts, which form arcuate flowthrough openings, said centrally disposed annular zone providing an opening through which said value element is guided.

2. A valve as defined by claim 1, characterized in that said armature has an area which is rounded off.

3. A valve as defined by claim 2. characterized in that said armature has an outer circumferential edge oriented toward said core which is rounded off.

4. A valve as defined by claim 1, characterized in that said valve element is provided with radially disposed apertures which are positioned beneath a point of contact between said other inwardly disposed annular zone and a wall of said valve element.

* * * * *